US009925994B2

(12) United States Patent
Ferrari et al.

(10) Patent No.: US 9,925,994 B2
(45) Date of Patent: Mar. 27, 2018

(54) CUTOUT SYSTEMS AND METHODS

(71) Applicant: Siemens Industry, Inc., Alpharetta, GA (US)

(72) Inventors: Remo Ferrari, East Brunswick, NJ (US); Torsten Pannier, Jersey City, NJ (US); James R. Krietemeyer, Brooklyn, NY (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 14/923,994

(22) Filed: Oct. 27, 2015

(65) Prior Publication Data

US 2017/0113708 A1 Apr. 27, 2017

(51) Int. Cl.

| | |
|---|---|
| ***B61L 3/00*** | (2006.01) |
| ***B61L 27/04*** | (2006.01) |
| ***B61L 27/00*** | (2006.01) |
| ***B61L 3/08*** | (2006.01) |
| ***B61L 3/16*** | (2006.01) |
| ***B61L 15/00*** | (2006.01) |

(52) U.S. Cl.

CPC ..... *B61L 27/0038* (2013.01); *B61L 3/006* (2013.01); *B61L 3/08* (2013.01); *B61L 3/16* (2013.01); *B61L 15/0018* (2013.01); *B61L 15/0072* (2013.01); *B61L 15/0081* (2013.01); *B61L 27/0077* (2013.01); *B61L 27/04* (2013.01)

(58) Field of Classification Search

CPC .. B61L 3/00; B61L 3/006; B61L 3/008; B61L 27/0038; B61L 27/0044; B61L 27/005; B61L 27/0077; B61L 27/0083; B61L 27/0088; B61L 27/04

See application file for complete search history.

(56) References Cited

U.S. PATENT DOCUMENTS 5,340,062 A * 8/1994 Heggestad ..... B61L 3/221 246/167 R
5,533,695 A * 7/1996 Heggestad ..... B61L 27/0038 246/1 R
5,978,718 A * 11/1999 Kull ..... B61L 3/008 246/167 R (Continued)

FOREIGN PATENT DOCUMENTS

DE 3023409 A1 * 1/1982
EP 2505452 A2 10/2012

OTHER PUBLICATIONS

Hann, Greg, "Incremental Train Control System", IEEE Vehicular Technology Magazine, Dec. 2010, 6 pages.*

(Continued)

*Primary Examiner* — Behrang Badii
*Assistant Examiner* — David A Testardi

(57) ABSTRACT

Systems and methods for controlling a train may override wayside interface units (WIUs) and/or override wayside devices. An example control system may comprise a transceiver configured to receive a status from a WIU and an on board unit (OBU) coupled to the transceiver. The OBU may be configured to override the command from the WIU and ignore a status from another wayside device associated with the WIU. The OBU may enforce all positive train control commands other than commands from sources associated with the overridden WIU.

22 Claims, 8 Drawing Sheets

Override WIU Approach

(56) References Cited

U.S. PATENT DOCUMENTS

| | | | | |
|---|---|---|---|---|
| 5,995,881 | A * | 11/1999 | Kull | B61L 3/008 246/182 A |
| 6,459,965 | B1 * | 10/2002 | Polivka | B61L 27/0038 180/168 |
| 7,236,860 | B2 | 6/2007 | Kane et al. | |
| 7,731,129 | B2 * | 6/2010 | Stull | B61L 27/0005 246/167 R |
| 2004/0069909 | A1 | 4/2004 | Kane et al. | |
| 2004/0102877 | A1 * | 5/2004 | Kane | B61L 3/12 701/19 |
| 2004/0124315 | A1 * | 7/2004 | Kane | B61L 1/20 246/111 |
| 2008/0103648 | A1 * | 5/2008 | Kanner | B61L 29/243 701/19 |
| 2012/0323411 | A1 * | 12/2012 | Whitwam | B61L 21/10 701/19 |
| 2014/0052315 | A1 * | 2/2014 | Isailovski | B61L 3/002 701/19 |
| 2014/0114507 | A1 * | 4/2014 | Kernwein | B61L 3/008 701/19 |
| 2015/0225003 | A1 * | 8/2015 | Morton | B61L 3/121 701/19 |
| 2015/0232110 | A1 * | 8/2015 | Ghaly | B61L 27/0055 246/62 |
| 2015/0307119 | A1 * | 10/2015 | Ghaly | B61L 27/0038 246/122 R |
| 2016/0257325 | A1 * | 9/2016 | Kernwein | B61L 27/04 |

OTHER PUBLICATIONS

FTA Research, "Rail Transit Shared Use and Control Systems Study", Final Report, Mar. 2014, FTA Report No. 0062, prepared by Lawrence E. Light, P.E., et al., 204 pages.*

Schmelzer, C., "Standardization of Cbtc Systems—Mixed Operation on Shared Lines in accordance with ERTMS/ETCS Standards", Published in: 8th World Congress on Railway Research, May 18-22, 2008, COEX, Seoul, Korea, 12 pages.*

Ansaldo STS TPWS Training Module for Loco Pilots, 2010, 74 pages, downloaded from: http://elocos.railnet.gov.in/Study_Material/TPWS/LPs'Training%20Module.pdf.*

EPO machine translation of DE 3023409 (original German document published Jan. 14, 1982).*

ERTMS-ETCS Functional Requirements Specification (FRS, Mar. 12, 1999, 196 pages).*

UX Design Edge, "Are you sure? How to write effective confirmations", Blog post be Everett McKay on Jun. 21, 2010, 6 pages, downloaded from: http://www.uxdesignedge.com/2010/06/are-you-sure-how-to-write-effective-confirmations/.*

Wikipedia article, Train Protection & Warning System, old revision dated Mar. 6, 2015, 6 pages.*

PCT International Search Report dated Apr. 7, 2017 corresponding to PCT International Application No. PCT/US2016/058609 filed Oct. 25, 2016 (20 pages).

PCT Invitation to Pay Additional Fees dated Feb. 16, 2017 corresponding to PCT Application No. PCT/US2016/058609 filed Oct. 25, 2016 (8pages).

* cited by examiner

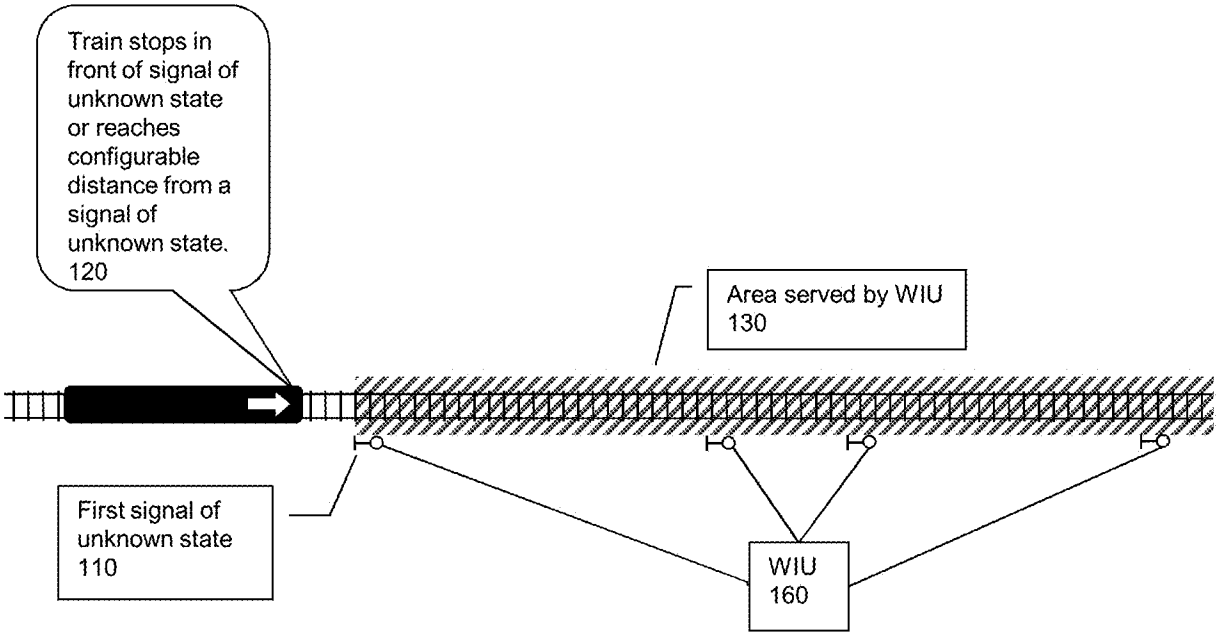
Figure 1A – Train Stops in Front of Signal

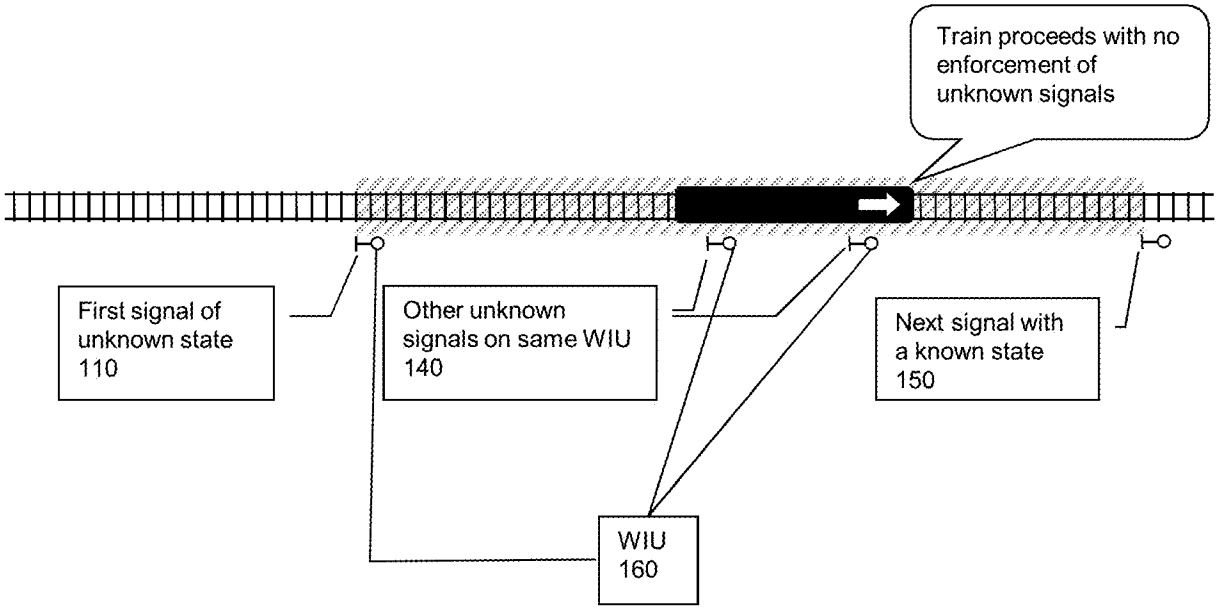
Figure 1B – Train Proceeds

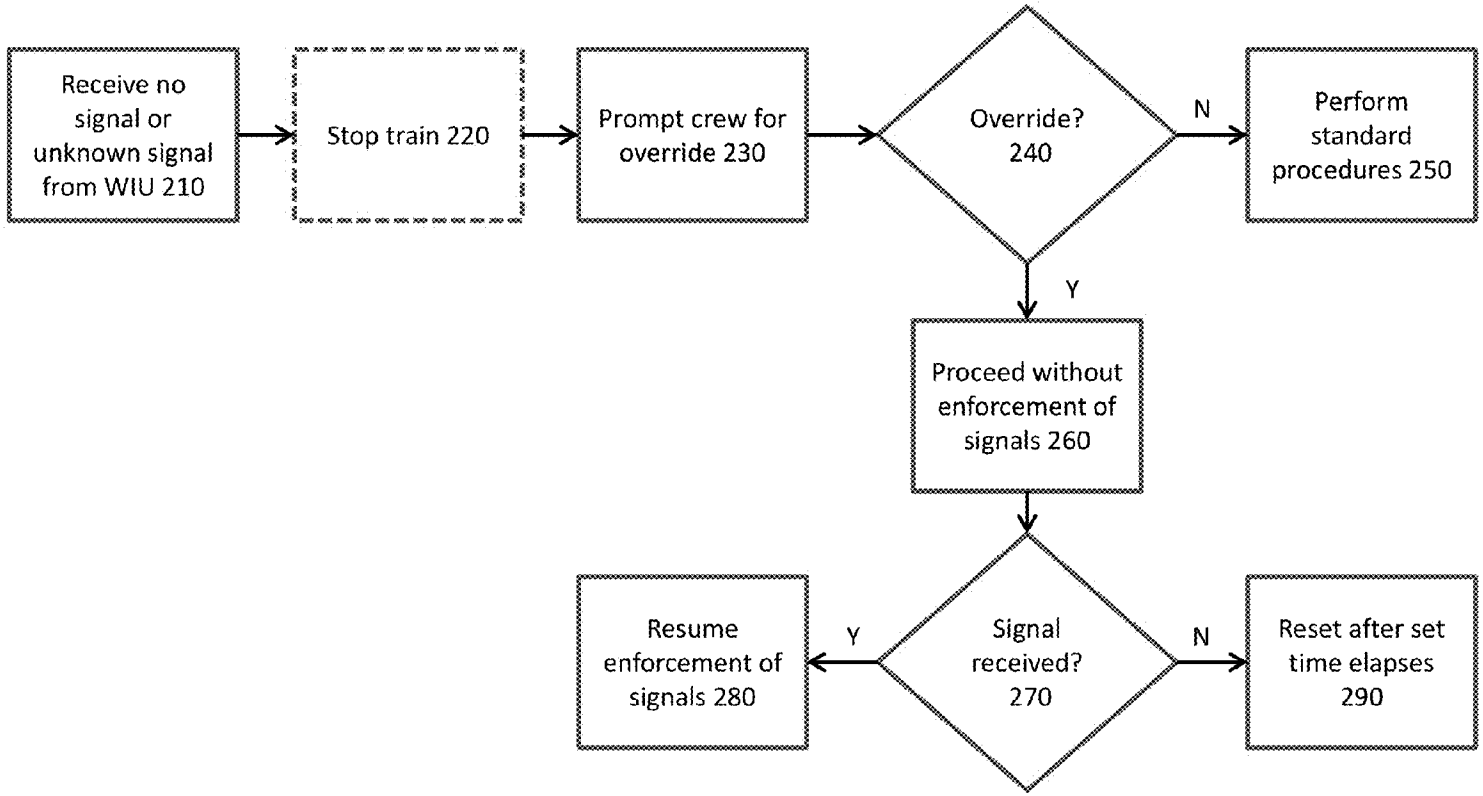
Figure 2 – Override WIU Approach

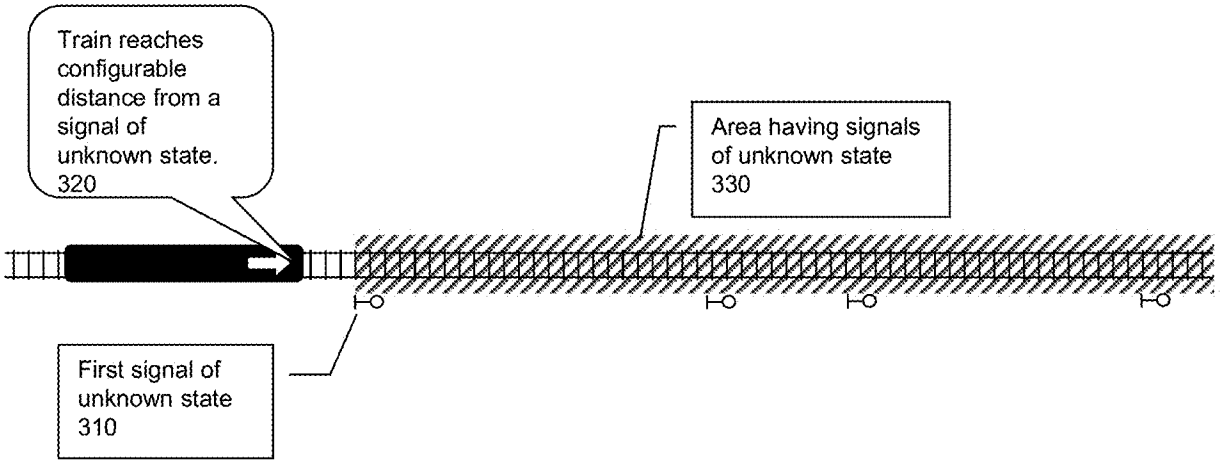
Figure 3A – Train Approaches Signal

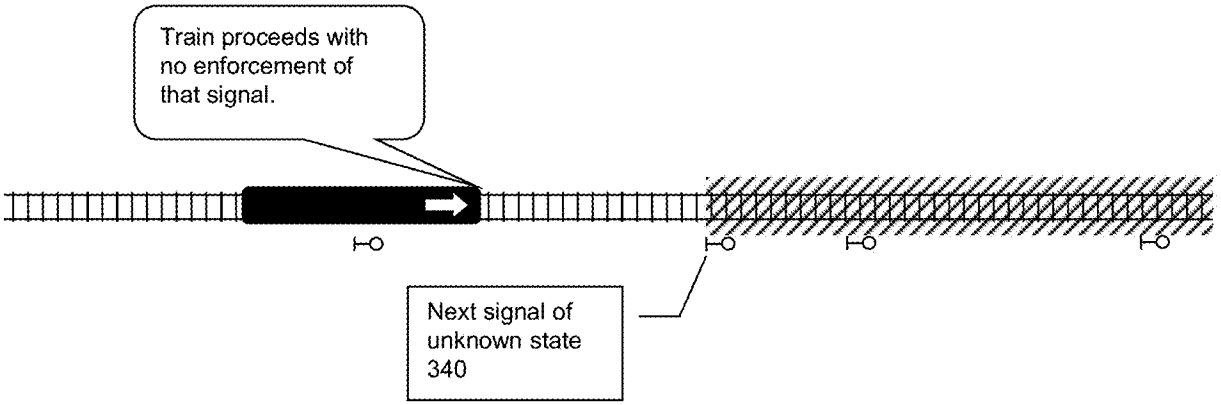
Figure 3B – Train Proceeds

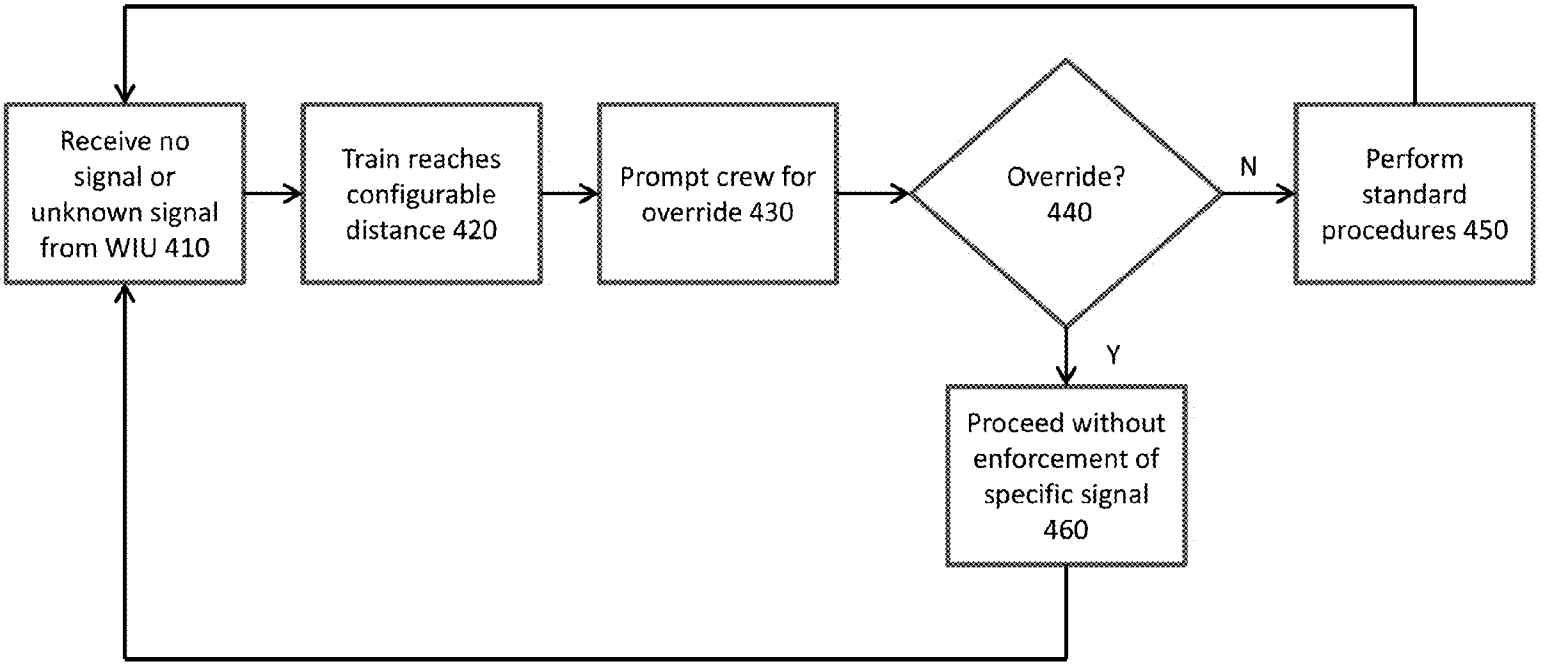
Figure 4 – Override Signal Approach

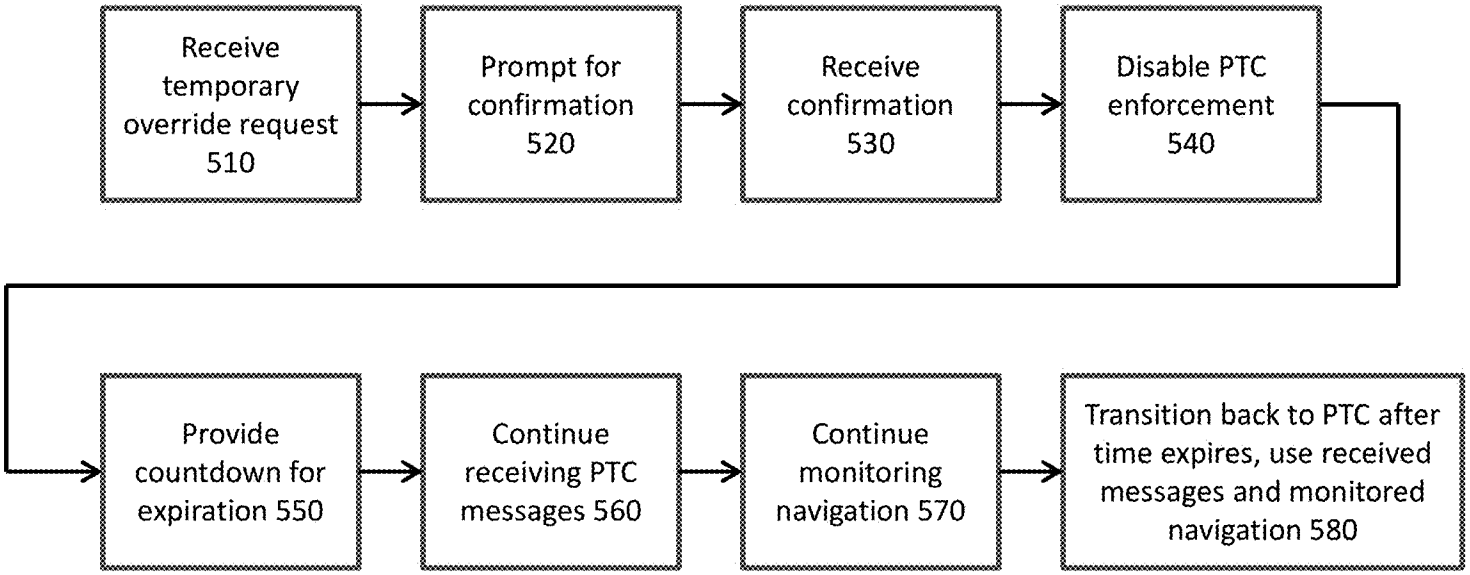
Figure 5 – Timer-Based Override Approach

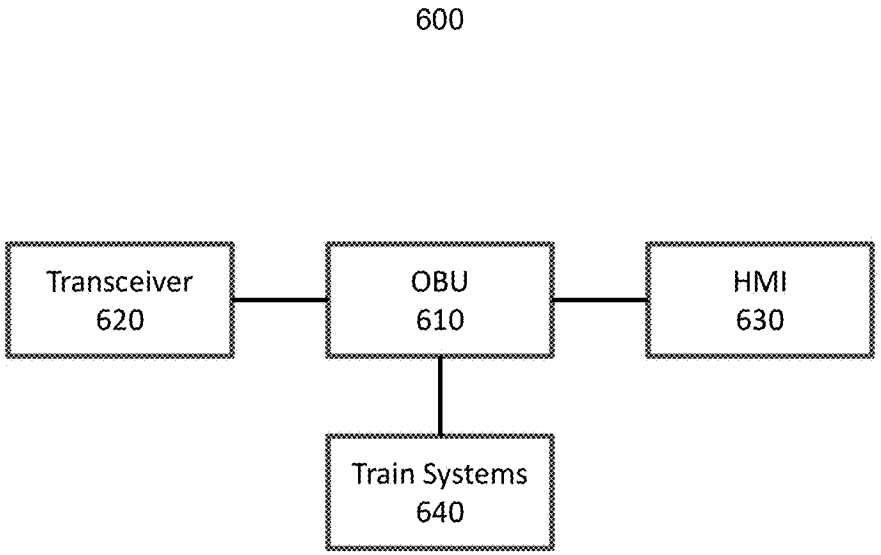
Figure 6 – Train Control

CUTOUT SYSTEMS AND METHODS

BACKGROUND

Interoperable train control (ITC)—positive train control (PTC) systems include on-board units (OBUs). The OBU provides a safety overlay for railroad operations through brake enforcement. However, in some cases a malfunctioning OBU cannot or does not release the brakes and thus disallows train movement. In order to overcome such situations, a hardware cutout switch can be used to physically isolate a malfunctioning OBU from a locomotive's brake system.

Situations may occur where the erroneous enforcement is not the result of a malfunctioning OBU, but is the consequence of another faulty element within the ITC-PTC system (e.g., a wayside interface unit (WIU) that is unable to communicate). Utilizing the hardware cutout in such cases may be ill-advised, since the fault does not originate within the OBU and therefore prohibiting OBU operation may decrease operational safety. On the other hand, resolving the situation may require a considerable amount of time and thus a substantial loss of revenue for the railroads.

A software cutout can address the erroneous enforcement issue. However, a software cutout is not tied to any operational condition and thus is not limited in its effect. An example of a conventional software cutout use case is as follows:

- OBU is in a state providing PTC functionality where the crew determines a need to cutout the OBU without using the hardware cutout switches.
- Crew selects the cutout softkey.
- OBU prompts for confirmation.
- Crew confirms prompt.
- OBU transitions to the cut-out mode (with appropriate display changes and back office server (BOS) report messages) and disables PTC enforcement.
- Crew can then proceed to operate the train on PTC track without PTC enforcement.
- When crew determines PTC should be re-engaged the crew selects the cut in softkey.
- The OBU performs an abbreviated initialization to ensure data is up-to-date and transitions back to active (with appropriate display changes and BOS report messages) and enables PTC enforcement.

Software cutout functionality can be employed during operational scenarios involving the loss of communication with a WIU which is monitoring a wayside device (e.g., a signal device, a switch/point, or a hazard detector), for example. Some specific example procedures implemented by the railroads are as follows:

- Signal at STOP is covered within ITC-PTC using communication between the dispatcher and the train engineer, a special form of movement authority and communication between the office- and locomotive segments.
- Switch is covered by procedure where the train engineer can manually enter the position of the switch on the human-machine interface (HMI) of the OBU after he/she verified that the switch is properly aligned.
- Hazard Detectors can be integrated with a signal system or in a standalone configuration. The former case is covered by signal at STOP (if a hazard is detected). The latter is covered by procedures using communication between the dispatcher and the train engineer and allows movement at restricted speed.

BRIEF DESCRIPTION OF THE DRAWINGS

FIGS. 1A-1B show a train proceeding along a track using a first override approach according to an embodiment of the invention.

FIG. 2 shows a first override approach according to an embodiment of the invention.

FIGS. 3A-3B show a train proceeding along a track using a second override approach according to an embodiment of the invention.

FIG. 4 shows a second override approach according to an embodiment of the invention.

FIG. 5 shows a third override approach according to an embodiment of the invention.

FIG. 6 shows a train control system according to an embodiment of the invention.

DETAILED DESCRIPTION OF SEVERAL EMBODIMENTS

Systems and methods described herein may provide cutout functionality called 'override' which may specifically and temporarily overcome issues arising from a faulty component of the ITC-PTC system while continuously providing the maximum available level of safety. Override may be accompanied by applicable corrective actions and may satisfy the mandated reporting responsibilities of railroads.

The systems and methods described herein may provide cutout functionality not only for the situations described in the background, but also for additional situations. Specifically, these approaches may handle the case where there is no wayside status received for a wayside device in a configurable amount of time, for example. In such a case, if no wayside status is received (e.g., signal device status not received), the OBU may assume the wayside device must be indicating a STOP. This assumption may be made in order to provide a maximum level of safety. The approaches described herein may override specific aspects of PTC enforcement within the OBU related to failures in other PTC subsystems without a significant decrease in the operational safety provided by the OBU. The approaches may include the following:

- An override WIU approach that disables enforcement of signals from wayside devices associated with a specific WIU; and
- An override wayside device approach that disables enforcement of signals for a single wayside device.

It is assumed that hazard detectors are treated as signal devices in both approaches.

Override WIU Approach

The override WIU approach may disable enforcement of signals from all wayside devices associated with a specific WIU with which the OBU has communication failures. It should be understood that a single WIU may be associated with (configured to transmit status for) one or multiple wayside devices of the same or different types. As used herein, "wayside device" includes a wide variety of devices for which it may be desirable to transmit a status including, without limitation, signal devices (i.e., a device located on a side of the track with colored lights that indicate how a train may proceed along a section of track associated with the device), crossing gates, track switches/points, avalanche detection circuits, track integrity circuits, bridge alignment circuits and the like. This approach may address the use case where the crew can see that a wayside device indicates that it is safe to proceed yet, since the wayside device status is unknown to the OBU (e.g., no wayside status message (WSM) received for that signal), the OBU may enforce a stop and hold the train until the WIU communication failure is resolved. An example of this may be a signal device indicating clear but the OBU preventing the train from passing the signal device. In this case it may be inappropriate for railroad operations to issue an authority to pass signal at stop to continue operation of the train because the signal device is not at stop. Further, issuing authority to pass signal at stop may require the train to proceed past the clear signal device at restricted speed, while the override WIU approach may allow traversal at track speed. The override WIU approach may provide a high degree of operational safety with smooth movement, limited user interaction, and no need for re-initialization.

FIGS. 1A and 1B illustrate an example of the override WIU approach, and FIG. 2 illustrates the override WIU approach procedure. A WIU 160 may serve an area 130 and monitor wayside devices (e.g., device 110) within the area 130. A train may approach a wayside device of unknown state 110, which may be a wayside device for which the OBU has not received WIU status in a configurable time (e.g., no status received 210 of FIG. 2), or incorrect state (e.g., the received data does not match the visual indication provided by the signal device, such as a STOP received when the signal device visually indicates it is safe to proceed; or the received data and/or visual indication indicate that a wayside device is configured in a manner inconsistent with the train's intended route, such as received status indicating that a switch is set to put the train on a portion of the track outside of the planned route, or a grade crossing gate alongside a section of track to be passed by the train is in the up or raised position). The train may come to a stop at a position 120 in front of the wayside device of unknown or incorrect state 110 (e.g., stop train 220 of FIG. 2). The crew may stop the train due to the unknown or incorrect status from the WIU 160. The OBU may prompt the crew to ask whether they want to disable enforcement of signals from the wayside devices associated with the WIU 160 for which the OBU has not received status or has received incorrect status (e.g., prompt crew for override 230 of FIG. 2). In some embodiments, the OBU may prompt the crew without waiting for the crew to stop the train. In this case, the OBU may send the prompt 230 when the train reaches a configurable distance from the wayside device of unknown or incorrect state 110. This embodiment may allow the override WIU approach to be performed without requiring a train stoppage by the crew. In either case, the crew may determine that it is safe to proceed despite a WIU status indicative of the contrary (e.g., override selected 240 of FIG. 2), so the crew may confirm the prompt. For example, the crew may determine that the track ahead is safe despite a received STOP status, or the crew may determine that the train can proceed on an unplanned portion of the track when a switch is set incorrectly. If the wayside device indicates otherwise (e.g., STOP) (e.g., override not selected 240 of FIG. 2), the crew may follow the well-defined procedure to pass signal at stop (PSS) under restricted speed (e.g., perform standard procedures 250 of FIG. 2).

If the override prompt is confirmed, the OBU may disable enforcement of signals from all wayside devices associated with WIU 160 for which the OBU has not received status or has received incorrect status, for example all wayside devices in the area 130 served by the WIU 160. The OBU may know which wayside devices are associated with the WIU 160 by checking a database that may be part of the OBU or in communication with the OBU (e.g., on the train or elsewhere). The database may contain data associating each WIU along the track with specific wayside devices (e.g., signals, switches, hazard detectors, etc.). Thus, as the train passes additional wayside devices without status or with incorrect status 140, the train may proceed without enforcement of unknown or incorrect status (e.g., proceed without enforcement of signals 260 of FIG. 2). The OBU may remain in the active mode and may continue to enforce all other speed restrictions and field elements (e.g., track speeds, wayside devices associated with other WIUs along the train's route, temporary speed restrictions, end of authority limits, etc.). Thus, PTC rules may be enforced generally, and only the messages specific to the overridden WIU 160 may be ignored. The OBU may continue to process messages from the BOS and WIUs. Display of disabled signals may be indicated on the human-machine interface (HMI). If the train crew encounters a signal device at STOP, the crew may follow the well-defined procedure to pass signal at stop (PSS) under restricted speed, despite the disabled enforcement for that specific signal device.

If the OBU receives status from the WIU 160 for which the OBU has disabled enforcement (e.g., signal received 270 of FIG. 2), the OBU may re-enable the enforcement of signals from the wayside devices 150 based on the updated WIU 160 status (e.g., resume enforcement of signals 280 of FIG. 2). Should the communication fail again, or should an incorrect status be encountered again, the OBU may re-prompt the crew to disable enforcement after stopping in front of the next wayside device with unknown or incorrect status. After a preconfigured amount of time (e.g., a default of 1 hour), the OBU may enable the enforcement of signals from the wayside devices that were previously disabled for enforcement if no WIU 160 status is received for those wayside devices (e.g., reset after set time elapses 290 of FIG. 2).

Override Wayside Device Approach

The override wayside device approach may override the speed restriction associated with an individual wayside device where WIU status has not been received for that wayside device in a configurable time, or where incorrect status has been received. The override wayside device approach may be similar to the override WIU approach in that it addresses the use case where the crew can see that a wayside device indicates clear, yet the OBU prevents movement due to a WIU communication failure. However, unlike the override WIU approach, the override wayside device approach may override PTC enforcement for a single individual wayside device. The override wayside device approach may provide a high degree of operational safety with moderate user interaction and no need for re-initialization.

FIGS. 3A and 3B illustrate an example of the override wayside device approach, and FIG. 4 illustrates the override wayside device approach procedure. A train may approach a wayside device of unknown or incorrect state 310 (e.g., no signal received 410 of FIG. 4). When the train is within a configurable distance 320 (i.e., viewable distance) of the wayside device (e.g., train reaches configurable distance 420 of FIG. 4), the OBU may prompt the crew to indicate whether it is safe to proceed (e.g., prompt crew for override 430 of FIG. 4). The OBU may also wait for the train to stop to prompt the crew in some embodiments. In either case, if the wayside device indicates it is safe to proceed, the crew may observe this indication and confirm the prompt (e.g., override selected 440 of FIG. 4). If the wayside device indicates otherwise (i.e., STOP) (e.g., override not selected 440 of FIG. 4), the crew may follow the well-defined procedure to pass signal at stop (PSS) under restricted speed (e.g., perform standard procedures 450 of FIG. 4). If the override prompt is confirmed, the OBU may release the speed restriction of the wayside device and allow the train to proceed at track speed (e.g., proceed without enforcement of specific signal 460 of FIG. 2). The OBU may remain in the active mode and may continue to enforce all other speed restrictions (e.g., track speeds, temporary speed restrictions, end of authority limits, etc.). The OBU may continue to process messages from the BOS and WIUs. Display of overridden wayside devices may be indicated on the train HMI. If the train encounters another wayside device of unknown or incorrect status 340 along the route (e.g., in an area of wayside device outage 330), the OBU may perform the prompt procedure again.

The override WIU approach and the override wayside device approach may allow trains to pass wayside devices without stopping at each wayside device and allow trains to pass wayside devices at track speed (not restricted speed as with pass signal at stop). Each approach may allow the OBU to remain in the active mode and provide near full PTC protection. Each approach may only be triggered in case of failed communication with a wayside device or incorrect wayside device state identified by the crew, thus allowing safe and normal WIU communication when available. The override WIU approach and the override wayside device approach may limit the need for crew interaction in these situations, as the crew may not have to explicitly cut the OBU back in through the HMI. Each approach may be used without abbreviated initialization, as the OBU may maintain messaging with the BOS, other WIUs, and its own datasets. This may reduce errors which can occur during abbreviated initialization that would force a full train initialization.

Timer-Based Override Approach

At any time while the OBU is providing PTC functionality, the train crew may be able to initiate a temporary override. Once a temporary override is initiated, PTC functionality may be disabled for a specified amount of time indicated by a timer. When the timer expires, the OBU may automatically return to a state providing full PTC functionality. FIG. 5 illustrates an example of the timer-based approach procedure. The procedure may begin when the OBU is in a state providing PTC and the crew determines a need to temporarily cut out the OBU. The crew may initiate a temporary override on the HMI, and their override request may be received by the OBU 510. The OBU may prompt for confirmation to cut out PTC for a preconfigured number of minutes (e.g., 30 minutes may be a default value in some embodiments), and the prompt may be communicated to the crew via the HMI 520. The crew may confirm the prompt via the HMI 530. The OBU may disable PTC enforcement 540 and operate in a PTC override mode. The OBU may provide a countdown display indicating when the temporary cut-out expires via the HMI 550. While PTC is not being enforced, the crew may control train operations without PTC restrictions imposed by the OBU (e.g., speed limits, etc.). While operating in the PTC override mode, the OBU may continue to process PTC messages from the WIU and the railroad's back offices 560 so that on a return to a state where PTC enforcement is provided, no additional crew and/or back office tasks (e.g., initialization) are required. The OBU may also continue to maintain its navigation 570, so that on return from cut-out it can enforce any PTC restrictions based on the location of the train. Once the temporary cutout time expires, the OBU may transition back to full PTC enforcement 580. Because PTC messages were processed in the background during cutout, and OBU navigation monitoring was maintained in the background during cutout, the OBU may transition back to PTC enforcement without performance of crew and/or back office tasks such as initialization.

By processing PTC messages and monitoring train movement while operating in the PTC override mode, the OBU may allow PTC operation to resume promptly upon expiration of the timer, because the scope of allowable operations for the location in which the train is operating will be known. The OBU may not need to receive updated information from the crew and/or railroad back office to resume PTC enforcement. Instead, the OBU may be able to effectively resume PTC enforcement from before PTC override occurred, taking into account PTC changes based on received wayside device statuses and/or train progress, without reentering information that was used to initialize the OBU at the start of the trip. Examples of initialization data that may need not be entered upon return to PTC operation may include crew member employee name and ID number entry, clearance number, train ID, etc.; train makeup, manifest, type, etc.; trip information (times, route, etc.); route information, track database, etc. from back office; back office verification of information entered by crew; system tests; etc.

In the timer-based approach, the OBU may always automatically transition back to PTC after the cutout period elapses. Thus, the OBU cannot be left indefinitely in a state where PTC is disabled. Also, the crew may not have to explicitly cut back to PTC in the OBU through the HMI. The OBU may maintain communication with all external systems (e.g., WIU, back offices) and may maintain navigation so no additional crew tasks are required on PTC cut-in.

Train Control

FIG. 6 shows a train control system 600 according to an embodiment of the invention. The system 600 may include an OBU 610, transceiver 620 (e.g., wireless transceiver, rail signal transceiver, etc.), HMI 630, and train systems (e.g., throttle, brakes, etc.) 640. The system 600 may control a train. For example, the OBU 610 may receive user commands via the HMI 630 and control the train systems 640 based on the user commands (e.g., a user instruction to slow the train may cause the system 600 to apply the brakes and/or reduce the throttle). Additionally, the OBU 610 may receive data from WIUs via the transceiver 620 and use this data to control the train (e.g., a WSM from a WIU may direct the system 600 to stop the train). The OBU 610 may include or be in communication with positioning systems (e.g., GPS) and/or may determine track position via statuses received from the transceiver 620. The system 600 may perform the override WIU approach 200 and/or the override wayside device approach 400 as described above.

As shown in FIGS. 1-2, in the override WIU approach, the transceiver 620 may receive no indication that it is safe to proceed from a WIU 110. Thus, the OBU 610 may control the train systems 640 to stop the train 120. The crew may use the HMI 630 to indicate that it is safe to proceed 130, and the OBU 610 may control the train systems 640 to move the train. As other wayside devices with unknown statuses are passed 140, the train may proceed without enforcement of unknown statuses 150. When the transceiver 620 receives a known status from a WIU 160, the OBU 610 may resume PTC enforcement for the train systems 640 normally and in accordance with the wayside device statuses.

As shown in FIGS. 3-4, in the override wayside device approach, the transceiver 620 may receive no indication that it is safe to proceed from a WIU 310. When the train reaches a configurable distance from the WIU 320, the OBU 610 may prompt the train crew for input via the HMI 630 as to whether the signal is clear 330. The crew may use the HMI 630 to indicate whether it is safe to proceed. If so, the OBU 610 may permit control of the train systems 640 to move the train 340. If not, the OBU 610 may cause the train systems 640 to stop the train. As other WIUs with unknown signals are approached 350, the prompting may be repeated. When the transceiver 620 receives a known signal from a WIU, the OBU 610 may resume PTC enforcement for the train systems 640 normally and in accordance with the WIU signals.

As shown in FIG. 5, in the timer-based override approach, the crew may use the HMI 630 to request and confirm a temporary PTC override. The OBU 610 may enable the override and provide a timer display via the HMI 630, indicating when the override will expire. During the override, train systems 640 may be controlled without PTC restrictions. During the override, the OBU 610 may receive PTC communications via the transceiver 620 and process the received communications. The OBU 610 may also continue to monitor train location during the override. When the override expires, the OBU 610 may resume PTC enforcement for the train systems 640 normally and in accordance with the PTC communications received during the override, as well as any ongoing and future PTC communications.

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments.

In addition, it should be understood that any figures that highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims, and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

What is claimed is:

1. A control system for controlling a train, the control system comprising:

a transceiver configured to receive data from a wayside interface unit (WIU), the WIU being configured to monitor a plurality of wayside devices and transmit the data, wherein the data describes a status of each of the plurality of wayside devices; and an on board unit (OBU) coupled to the transceiver and configured to:

determine that the train is approaching the WIU;

determine that a state of a first wayside device monitored by the WIU is incorrect based on the data received by the transceiver from the WIU or the state of the first wayside device monitored by WIU is unknown based on a failure by the transceiver to receive the data from the WIU;

based on the determination of incorrect or unknown state, prompt a user for an override of the first wayside device monitored by the WIU;

receive the override;

allow the train to proceed past the first wayside device monitored by the WIU;

ignore data describing a status of another wayside device monitored by the WIU; and enforce positive train control restrictions associated with a status of at least one wayside device other than the plurality of wayside devices monitored by the WIU during a time period to which the override applies.

2. The control system of claim 1, wherein the OBU is further configured to determine that the train has stopped before prompting the user for the override.

3. The control system of claim 1, wherein the OBU is further configured to cancel the override after a predetermined time elapses from a time when the override is received and respond to data originating from wayside devices monitored by the WIU after the override is canceled.

4. The control system of claim 1, wherein the OBU is further configured to prompt the user for the override when the train reaches a predetermined distance from the WIU.

5. A method for controlling a train, the method comprising:

determining, with an on board unit (OBU), that the train is approaching a wayside interface unit (WIU), the WIU being configured to monitor a plurality of wayside devices and transmit data describing a status of each of the plurality of wayside devices;

determining, with the OBU, that a state of a first wayside device monitored by the WIU is incorrect based on data received by a transceiver from the WIU or the state of the first wayside device monitored by the WIU is unknown based on a failure by the transceiver to receive the data from the WIU;

based on the determination of incorrect or unknown state, prompting, with the OBU, a user for an override of the WIU;

receiving, with the OBU, the override;

allowing, with the OBU, the train to proceed past the first wayside device monitored by the WIU;

ignoring, with the OBU, data describing a status of another wayside device monitored by the WIU: and enforcing, with the OBU, positive train control restrictions associated with a status of at least one wayside device other than the plurality of wayside devices monitored by the WIU during a time period to which the override applies.

6. The method of claim 5, further comprising determining, with the OBU, that the train has stopped before prompting the user for the override.

7. The method of claim 5, further comprising canceling, with the OBU, the override after a predetermined time elapses from a time when the override is received and respond to data originating from wayside devices monitored by the WIU after the override is canceled.

8. The method of claim 5, wherein the OBU prompts the user for the override when the train reaches a predetermined distance from the WIU.

9. A control system for controlling a train, the control system comprising:

a transceiver configured to receive data from a wayside interface unit (WIU), the WIU being configured to monitor a plurality of wayside devices and transmit the data, wherein the data describes a status of each of the plurality of wayside devices; and an on board unit (OBU) coupled to the transceiver and configured to:

override a positive train control restriction, the positive train control restriction being based on the data from the WIU;

ignore data describing a status of a wayside device monitored by the WIU; and enforce positive train control restrictions associated with a status of at least one wayside device other than the plurality of wayside devices monitored by the WIU during a time period to which the override applies.

10. The control system of claim 9, wherein the OBU is further configured to:

determine that the train is approaching the WIU, the WIU being associated with a plurality of wayside devices;

determine that a state of a first wayside device associated with the WIU is incorrect based on data received by the transceiver from the WIU or the state of the first wayside device monitored by the WIU is unknown based on a failure by the transceiver to receive the data from the WIU; and based on the determination of incorrect or unknown state, prompt a user for an override of the WIU.

11. The control system of claim 9, wherein the OBU is further configured to cancel the override after a predetermined time elapses from a time when the positive train control restriction is overridden and respond to data originating from wayside devices monitored by the WIU after the override is canceled.

12. A method for controlling a train, the method comprising:

receiving, with a transceiver, data from a wayside interface unit (WIU), the WIU being configured to monitor a plurality of wayside devices and transmit the data, wherein the data describes a status of each of the plurality of wayside devices;

overriding, with an on board unit (OBU), a positive train control restriction, the positive train control restriction being based on the data from the WIU;

ignoring, with the OBU, data describing a status of another wayside device monitored by the WIU; and enforcing, with the OBU, positive train control restrictions associated with a status of at least one wayside device other than the plurality of wayside devices monitored by the WIU during a time period for which the overriding applies.

13. The method of claim 12, further comprising:

determining, with the OBU, that the train is approaching the WIU, the WIU being configured to monitor a plurality of wayside devices;

determining, with the OBU, that a state of a first wayside device monitored by the WIU is incorrect based on data received by a transceiver from the WIU or the state of the first wayside device monitored by the WIU is unknown based on a failure by the transceiver to receive the data from the WIU; and based on the determination of incorrect or unknown state, prompting, with the OBU, a user for an override of the WIU.

14. The method of claim 12, further comprising canceling, with the OBU, the override after a predetermined time elapses from the overriding and responding to data originating from wayside devices monitored by the WIU after the override is canceled.

15. A control system for controlling a train, the control system comprising:

a transceiver configured to receive positive train control (PTC) commands; and an on board unit (OBU) coupled to the transceiver and configured to:

place train control in a state providing PTC;

receive a PTC override command;

place train control in a PTC override mode for a predetermined time period in response to the PTC override command;

while train control is in the PTC override mode during the predetermined time period, receive data describing at least one status of at least one wayside device and update PTC restrictions based on the received data without enforcing the PTC restrictions;

while train control is in the PTC override mode during the predetermined time period, monitor a track position of the train; and after the predetermined time period elapses, place train control in the state providing PTC and provide PTC for the monitored track position of the train without reinitializing the OBU for the trip.

16. The control system of claim 15, wherein placing train control in the PTC mode comprises controlling the train in accordance with the data describing the at least one status of the at least one wayside device received while train control was in the PTC override mode.

17. The control system of claim 15, wherein the OBU is further configured to display a timer indicating when the predetermined time period will elapse while train control is in the PTC override mode.

18. The control system of claim 15, wherein the OBU is further configured to:

prompt a user for a confirmation of the override command; and receive the confirmation before placing train control in the PTC override mode.

19. A method for controlling a train, the method comprising:

placing, with an on board unit (OBU), train control in a state providing positive train control (PTC);

receiving, with the OBU, a PTC override command;

placing, with the OBU, train control in a PTC override mode for a predetermined time period in response to the PTC override command;

while train control is in the PTC override mode during the predetermined time period, receiving, with the OBU, data describing at least one status of at least one wayside device and updating, with the OBU, PTC restrictions based on the received data without enforcing the PTC restrictions;

while the train control is in the PTC override mode during the predetermined time period, monitoring, with the OBU, a track position of the train; and after the predetermined time period elapses, placing, with the OBU, train control in the state providing PTC and providing PTC for the monitored track position of the train without reinitializing the OBU for the trip.

20. The method of claim 19, wherein placing train control in the PTC mode comprises controlling the train in accordance with the data describing the at least one status of the at least one wayside device received while train control was in the PTC override mode.

21. The method of claim 19, further comprising displaying, with the OBU, a timer indicating when the predetermined time period will elapse while the train control is in the PTC override mode.

22. The method of claim 19, further comprising:

prompting, with the OBU, a user for a confirmation of the override command; and receiving, with the OBU, the confirmation before placing train control in the PTC override mode.

* * * * *